US007686701B2

(12) United States Patent
Hasegawa

(10) Patent No.: US 7,686,701 B2
(45) Date of Patent: Mar. 30, 2010

(54) SHAFT BEHAVIOR AUTOMATIC MEASURING SYSTEM

(75) Inventor: Hiroshi Hasegawa, Kobe (JP)

(73) Assignee: SRI Sports Limited, Kobe (JP)

( * ) Notice: Subject to any disclaimer, the term of this patent is extended or adjusted under 35 U.S.C. 154(b) by 593 days.

(21) Appl. No.: 11/519,836

(22) Filed: Sep. 13, 2006

(65) Prior Publication Data

US 2007/0105639 A1 May 10, 2007

(30) Foreign Application Priority Data

Nov. 10, 2005 (JP) ..... 2005-326343

(51) Int. Cl.
*A63B 69/36* (2006.01)

(52) U.S. Cl. ..... 473/221; 473/257

(58) Field of Classification Search ..... 473/131, 473/151, 152, 155, 156, 198–200, 219–226, 473/257, 407, 409; 342/104, 113, 114, 117, 342/59, 107, 179
See application file for complete search history.

(56) References Cited

U.S. PATENT DOCUMENTS 3,788,647 A * 1/1974 Evans ..... 473/223
3,945,646 A * 3/1976 Hammond ..... 473/223
5,056,783 A * 10/1991 Matcovich et al. ..... 473/453
5,741,182 A * 4/1998 Lipps et al. ..... 463/36
6,456,232 B1 * 9/2002 Milnes et al. ..... 342/107
6,758,759 B2 * 7/2004 Gobush et al. ..... 473/131
7,166,035 B2 * 1/2007 Voges et al. ..... 473/222
2004/0057828 A1 * 3/2004 Bosche ..... 416/1
2005/0202887 A1 * 9/2005 Otten et al. ..... 473/151
2008/0200274 A1 * 8/2008 Haag et al. ..... 473/222

FOREIGN PATENT DOCUMENTS

JP 11-178953 A 7/1999

* cited by examiner

*Primary Examiner*—Nini Legesse
(74) *Attorney, Agent, or Firm*—Birch, Stewart, Kolasch & Birch, LLP

(57) ABSTRACT

A shaft behavior automatic measuring system 2 according to the present invention includes a metal member 14 provided on a surface of a shaft 8 in a golf club 4, and a radar device 6 to be a Doppler radar. The radar device 6 has at least one transmitting portion for emitting a radar wave to the metal member 14 in the golf club 4 during a swing and at least three receiving portions 16 for receiving the radar wave reflected from the metal member 14. The shaft behavior automatic measuring system 2 includes a calculating portion for calculating three-dimensional coordinates of the metal member 14 based on a signal received by the at least three receiving portions 16. A coating material containing metal powder, a resin sheet containing metal powder, a metallic foil and a metallic thin film are taken as an example of the metal member 14.

8 Claims, 7 Drawing Sheets

SHAFT BEHAVIOR AUTOMATIC MEASURING SYSTEM

This application claims priority on Patent Application No. 2005-326343 filed in JAPAN on Nov. 10, 2005, the entire contents of which are hereby incorporated by reference.

BACKGROUND OF THE INVENTION

1. Field of the Invention

The present invention relates to a shaft behavior automatic measuring system capable of measuring a behavior of a shaft during a swing.

2. Description of the Related Art

As a method of measuring a behavior of a golf club shaft during a swing, a method using a strain gauge has been known. Japanese Laid-Open Patent Publication No. 11-178953 has disclosed a technique for sticking a strain gauge into a plurality of positions in a longitudinal direction of a shaft and measuring a behavior of the shaft based on strain data obtained from each of the strain gauges.

The strain gauge is connected to a wiring. The wiring disturbs a swing and remarkably interferes with the swing of a golf player. Due to the wiring, the golf player cannot carry out the swing as usual. Moreover, weights of a golf club and a shaft are increased depending on a weight of the strain gauge and the wiring. Because of the increase in the weights, the golf club and the shaft have different specifications from a state in which the strain gauge is not attached. The increase in the weight disturbs a normal swing of the golf player. The increase in the weight interferes with an original behavior of the golf club shaft.

As a method which does not use the strain gauge, it is possible to propose a method using a high speed camera. A mark is put in a plurality of positions in the longitudinal direction of the shaft and a behavior of the mark is analyzed based on an image photographed by means of the high speed camera. By providing a plurality of high speed cameras and photographing a swing on a plurality of points of view, it is possible to obtain a three-dimensional behavior of each mark. However, the method using the high speed camera requires a long time for an analysis. Moreover, the method using the high speed camera has poor precision in a measurement.

SUMMARY OF THE INVENTION

It is an object of the present invention to provide a shaft behavior automatic measuring system which disturbs a swing with difficulty and can three-dimensionally measure a behavior of a shaft.

A shaft behavior automatic measuring system according to the present invention comprises a metal member provided on a surface of a shaft attached to a golf club and a Doppler radar. The Doppler radar includes at least one transmitting portion for emitting a radar wave to the metal member in the golf club during a swing and at least three receiving portions for receiving the radar wave reflected from the metal member. The shaft behavior automatic measuring system comprises a calculating portion for calculating three-dimensional coordinates of the metal member based on a signal received by the at least three receiving portions.

In the shaft behavior automatic measuring system, it is preferable that the metal member should be set to be a coating material containing metal powder, a resin sheet containing metal powder, a metallic foil or a metallic thin film. It is preferable that a total weight of the metal member should be set to be equal to or smaller than 3% of a total weight of the club.

It is preferable that a distance between the transmitting portion and receiving portion and the metal member should be set to be 0.5 to 8 m within a full range of the swing.

By means of the Doppler radar, it is possible to measure a three-dimensional position of the metal member provided on the shaft. The present invention uses the Doppler radar. Therefore, the swing is disturbed with difficulty.

DESCRIPTION OF THE PREFERRED EMBODIMENTS

The present invention will be described below in detail based on a preferred embodiment with reference to the accompanying drawings.

Figure 1:
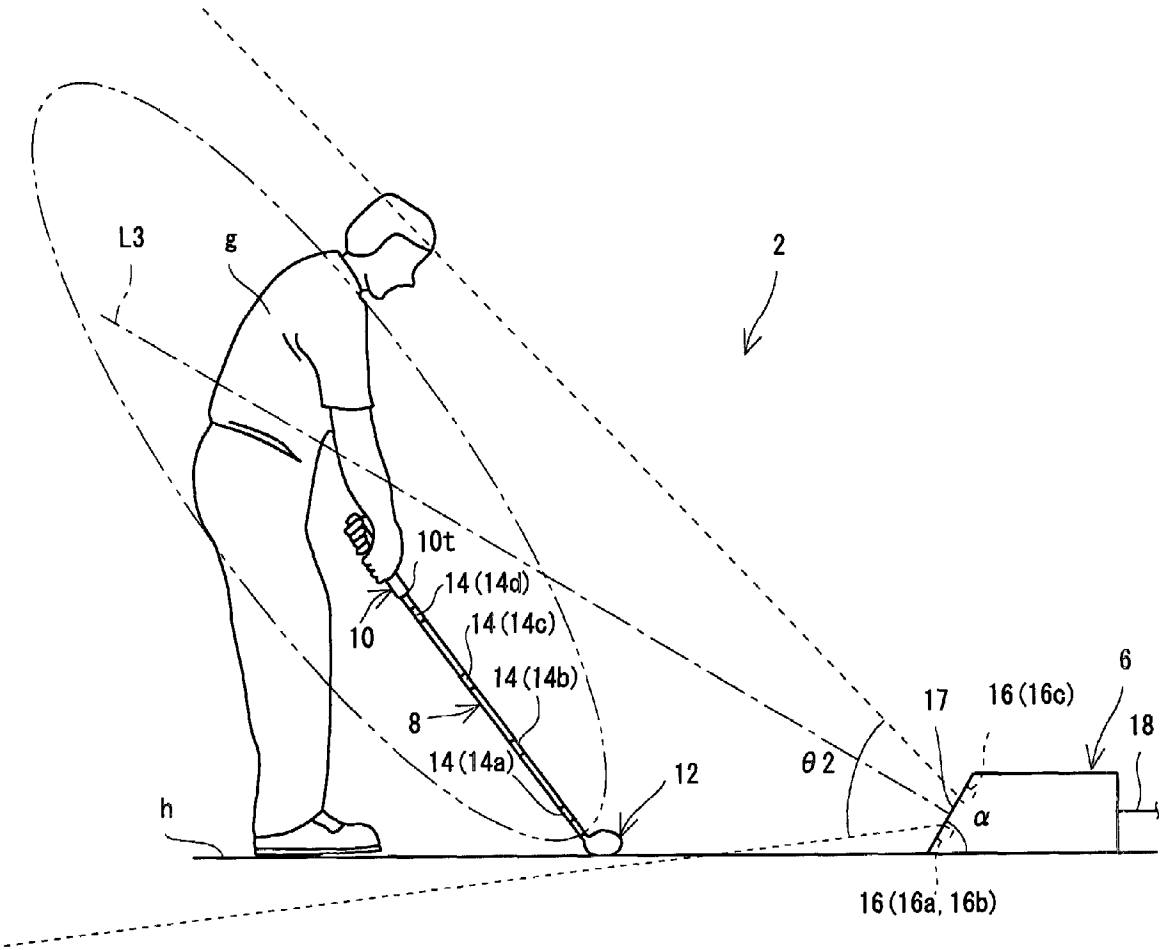
FIG. 1 is a side view showing a shaft behavior automatic measuring system according to an embodiment of the present invention.

FIG. 1 shows a golf player g together with a shaft behavior automatic measuring system 2. The shaft behavior automatic measuring system 2 comprises a metal member 14 and a radar device 6. The metal member 14 is attached to a golf club shaft 8 of a golf club 4. The golf club 4 has the golf club shaft 8, a grip 10 and a golf club head 12. The head 12 is attached to one of ends of the shaft 8, and the grip 10 is attached to the other end of the shaft 8. The golf player g carries out a swing while gripping the grip 10. The golf player g is an example of a swing actor (serving to swing the golf club 4).

The shaft 8 is a so-called carbon shaft. The shaft 8 is formed of CFRP (carbon fiber reinforced plastic). The shaft 8 has the metal member 14 exposed in a plurality of portions in a longitudinal direction of the shaft. The metal member 14 is separate from a shaft body, for example. The metal member 14 is formed by a coating material containing metal powder, a resin sheet containing metal powder, a metallic foil or a metallic thin film. The metal member 14 may be plating containing a metal. The metal member 14 covers a surface of the shaft. The metal member 14 is provided over a whole periphery of the shaft having a circular section, which is not shown. It is sufficient that the metal member is present on at least the surface of the shaft. A thing which contains metal powder is the metal member. A thing which contains a metal ion is the metal member. A thing which contains a metal atom is the metal member. The type of the metal atom contained in the metal member is not particularly restricted.

The coating material containing the metal powder may be directly applied to the surface of the shaft body and may be applied to the surface of a base material constituted by an adhesive tape or an adhesive resin. The metallic foil may be provided on the surface of the base material constituted by the adhesive tape or the adhesive resin. The metallic thin film may be directly formed on the body of the shaft or may be provided on the surface of the base material formed by the adhesive tape or the adhesive resin. Examples of a method of forming a metallic thin film include PVD (Physical Vapor Deposition), CVD (Chemical Vapor Deposition) and the like.

In respect of a reduction in a weight of the metal member 14, light metals are preferable for the type of a metal contained in the metal member 14. More specifically, it is preferable that the type of the metal contained in the metal member 14 should include aluminum, an aluminum alloy, magnesium, a magnesium alloy, titanium, a titanium alloy and the like. In respect of a reduction in the weight of the metal member 14, it is preferable that a specific gravity of the metal contained in the metal member 14 should be equal to or smaller than five.

In respect of a suppression of an increase in a weight of the golf club 4 which is measured, the weight of the metal member 14 (a total weight in the case in which a plurality of metal members 14 is provided) is preferably set to be equal to or smaller than 3% of the weight of the golf club 4 (a weight in a state in which the metal member 14 is not provided) and is more preferably set to be equal to or smaller than 1%. In order to suppress a change in a club balance of the golf club 4 which is measured and to prevent a change in a swing and a shaft behavior depending on the presence of the metal member 14, the change in the club balance of the golf club 4 which is caused by the installation of the metal member 14 is preferably set to be equal to or smaller than two points and is more preferably set to be equal to or smaller than one point. The club balance uses a 14-inch method. The change in the club balance of the golf club 4 depending on the installation of the metal member 14 which is equal to or smaller than two points implies that the club balance of the golf club after the installation of the metal member 14 ranges from D4 to D0 in the case in which the club balance of the golf club before the installation of the metal member 14 (in a normal using state) is D2, for example.

The metal member 14 is present on the surface of the shaft 8. The metal member 14 is locally disposed on the surface of the shaft 8. By tracking a position of the metal member 14 disposed locally, a behavior of the shaft 8 in a specific position (in which the metal member 14 is provided) is measured. In respect of an increase in a locality of the metal member 14, a length of the metal member 14 in the longitudinal direction of the shaft is preferably set to be equal to or smaller than 40 mm and is more preferably set to be equal to or smaller than 30 mm. In respect of an enhancement in precision in a measurement with an increase in a strength of a radar wave reflected by the metal member 14, the length of the metal member 14 in the longitudinal direction of the shaft is preferably set to be equal to or greater than 1 mm and is more preferably set to be equal to or greater than 3 mm.

It is preferable that the metal member 14 should be provided in a plurality of portions in the longitudinal direction of the shaft 8. By providing the metal member 14 in the portions, it is possible to measure the behavior of the shaft 8 (bending) with higher precision. In respect of an enhancement in the precision in a measurement of the bending of the shaft 8, the position of the metal member 14 in the longitudinal direction of the shaft is preferably placed in three portions or more and is more preferably placed in five portions or more. In respect of the easiness of an analysis of a received wave, the position of the metal member 14 in the longitudinal direction of the shaft is preferably placed in 20 portions or less and is more preferably placed in 15 portions or less.

In respect of an efficient measurement of the bending of the shaft 8, it is preferable that the metal members 14 should be disposed at a regular interval in the longitudinal direction of the shaft. In respect of a whole measurement of the bending of the shaft 8, a distance in the longitudinal direction of the shaft between the metal member 14 which is provided on the shaft 8 and is placed in the closest position to the head 12 and an end face of a neck of the head 12 is preferably set to be equal to or smaller than 200 mm and is more preferably set to be equal to or smaller than 100 mm. In order to wholly measure the bending of the shaft 8, a distance in the longitudinal direction of the shaft between the metal member 14 which is provided on the shaft 8 and is placed in the closest position to the grip 10 and an edge 10*t* on the head side of the grip 10 is preferably set to be equal to or smaller than 200 mm and is more preferably set to be equal to or smaller than 100 mm.

The shaft 8 may be a so-called steel shaft. In case of the steel shaft, the metal member 14 may be separate from the shaft body. For example, it is possible to employ a structure in which the whole steel shaft is covered with a non-metal member, and furthermore, a metal member is provided in a plurality of portions in the longitudinal direction of the shaft. Moreover, the shaft body of the steel shaft may be utilized as the metal member. For example, it is possible to employ a structure in which a surface of the shaft body is covered with a non-metal member (a coating material, a resin tape or the like) excluding a plurality of portions in the longitudinal direction of the steel shaft and the shaft body is exposed in a plurality of portions in the longitudinal direction of the shaft. It is possible to employ a coating material which does not contain metal powder, a resin sheet which does not contain the metal powder and the like as the non-metal member for covering the shaft.

In addition to the surface of the shaft 8, the metal member 14 may be provided on the surface of the head 12. In the case in which the metal 12 is formed of a metal, the whole surface of the head 12 may be covered with a non-metal member (a coating material, a resin tape or the like) and a separate metal member from the head 12 may be provided. In the case in which the behavior of the head 12 is to be excluded from a measuring target and the head 12 is formed of a metal, moreover, it is possible to employ a structure in which the whole surface of the head 12 is covered with a non-metal member (a coating material, a resin tape or the like).

In the case in which the golf player g is to be excluded from the measuring target, it is preferable to use a measuring method of carrying out a measurement without the golf player g wearing the metal member. When the golf player g does not wear the metal member, the precision in the measurement of the shaft 8 is enhanced more greatly. In the case in which the golf player g is to be included in the measuring target, it is possible to employ a measuring method of providing the metal member 14 in a desirable position in the golf player g to carry out the measurement.

The metal member 14 is provided on the surface of the shaft. The metal member 14 is exposed from the surface of the shaft. The metal member 14 can reflect a radar wave generated from the radar device 6. A non-metal member as well as the metal member can reflect the radar wave. The radar device 6 can also receive the radar wave reflected from the non-metal member as well as the radar wave reflected from the metal member. A reflectance of the radar wave of the metal member is higher than that of the radar wave of the non-metal member. In the case in which the metal member is exposed, the reflectance of the radar wave reflected from the exposed surface is further higher. Accordingly, it is possible to distinguish the radar wave reflected from the exposed surface of the metal member from the radar wave reflected from the non-metal member by providing a predetermined threshold on a strength of the received wave, for example. A sensitivity of the radar device 6 may be set in order to freely sense only the wave reflected from the metal member without sensing the wave reflected from the non-metal member.

Figure 2:
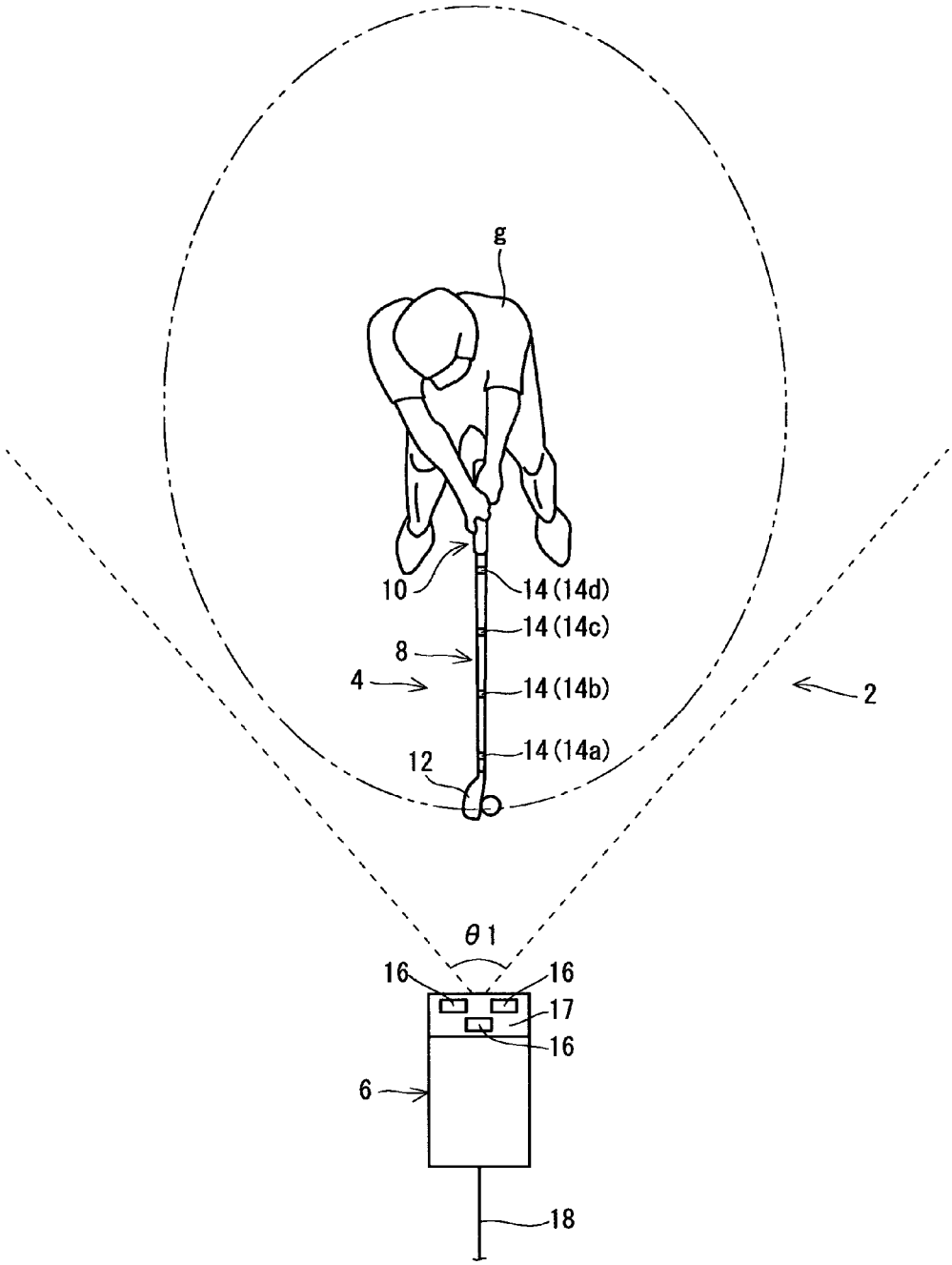
FIG. 2 is a view seen from a top in FIG. 1.

The radar device 6 has one transmitting portion, which is not shown in FIGS. 1 and 2. The radar device 6 has three receiving portions 16. The transmitting portion emits a radar wave to the metal member 14 of the golf club during a swing. The receiving portion 16 receives a radar wave reflected from the metal member 14. The shaft behavior automatic measuring system 2 comprises a calculating portion for calculating three-dimensional coordinates of the metal member 14 based on a signal received by the receiving portion 16, which is not shown in FIGS. 1 and 2. The calculating portion is provided in the radar device 6. The calculating portion may be provided in a computer or the like which is connected to the radar device 6.

Figure 3:
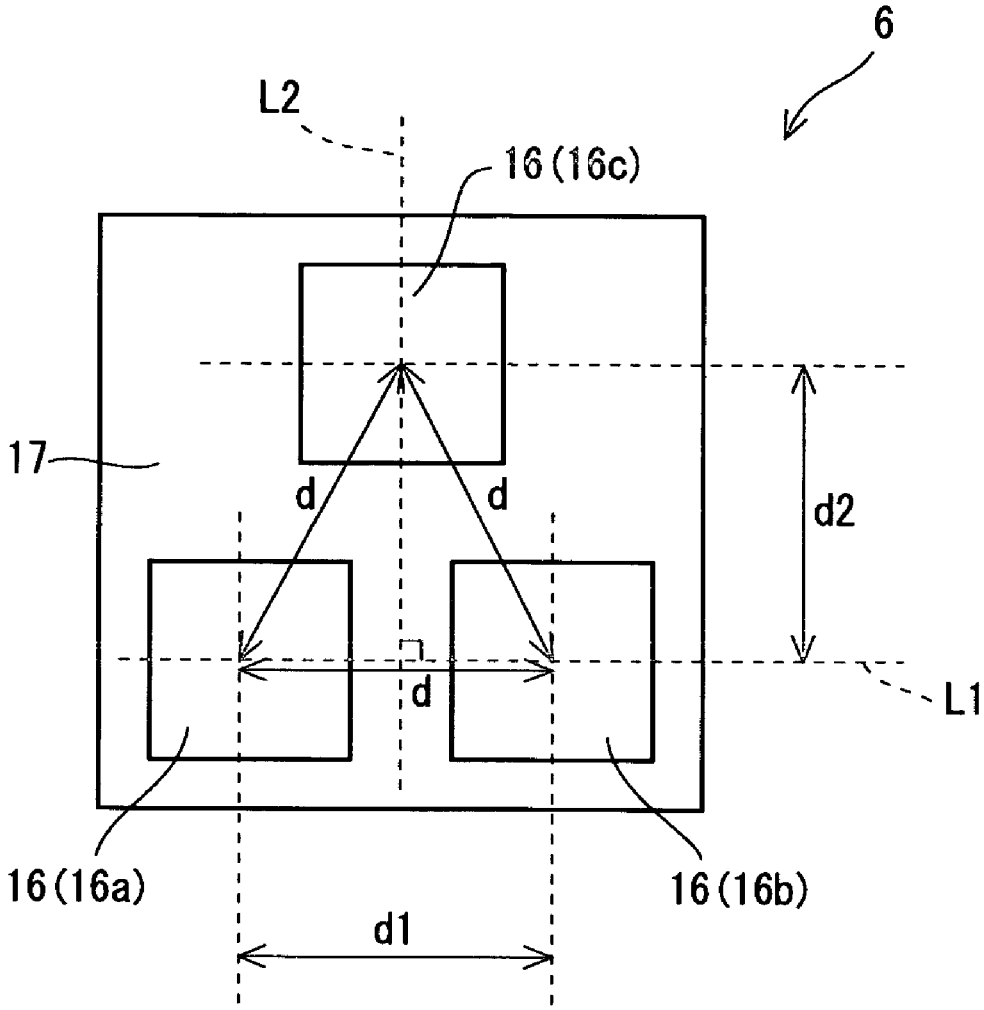
FIG. 3 is a front view showing a radar device.

The radar device 6 has a receiving portion installation surface 17. All of three receiving portions 16 are disposed along the receiving portion installation surface 17. The receiving portion installation surface 17 is a plane. FIG. 3 is a front view showing the receiving portion installation surface 17. Installation heights of two receiving portions 16*a* and 16*b* (installation heights from a ground h) are almost equal to each other. An installation height of a receiving portion 16*c* is greater than installation heights of the receiving portions 16*a* and 16*b*. The receiving portion 16*c* is positioned on a perpendicular bisector L2 of a line L1 connecting the receiving portions 16*a* and 16*b* over the receiving portion installation surface 17 (see FIG. 3).

In respect of a structure in which all of the receiving portions 16 can easily receive the wave reflected from the metal member 14, it is preferable that an angle $\alpha$ formed by a horizontal plane and the receiving portion installation surface 17 (see FIG. 1) should be set to be equal to or greater than 45 degrees. In respect of a structure in which all of the receiving portions 16 can easily receive the wave reflected from the metal member 14, it is preferable that the angle $\alpha$ formed by the horizontal plane and the receiving portion installation surface 17 (see FIG. 1) should be set to be equal to or smaller than 90 degrees. In respect of a structure in which all of the receiving portions 16 can easily receive the wave reflected from the metal member 14, it is preferable that a normal L3 of the receiving portion installation surface 17 which passes through a center of the receiving portion installation surface 17 should pass through an inside of a swing actor (the golf player g, a swing robot or the like).

The shaft behavior automatic measuring system 2 has a computer portion which is not shown. The radar device 6 is connected to a computer such as a personal computer through a wiring 18. The computer connected to the radar device 6 is a computer portion. The radar device 6 is directly connected to the computer.

The radar device 6 can measure relative velocities of an object to be measured (the metal member 14) and the radar device 6 by the principle of a Doppler shift. The radar device 6 is a Doppler radar. Moreover, a transmitting portion of the radar device 6 transmits a millimeter wave. The radar device 6 is a millimeter wave radar.

The millimeter wave radar is a radar system using a millimeter wave. The millimeter wave is an electric wave having a wavelength in millimeters. The millimeter wave has a frequency of 30 GHz to 300 GHz. A millimeter wave radar and a laser radar have been known as radars for measuring a distance. In particular, the millimeter wave radar can stably catch a target (that is, the metal member 14) also in a state of rain or fog. The millimeter wave radar can carry out a measurement which does not depend on a weather. The millimeter wave radar can carry out the measurement in a dark place.

An arrangement of the radar device 6 is not particularly restricted. It is preferable that the radar device 6 should be disposed in a suitable position for the measurement. As shown in FIGS. 1 and 2, it is preferable that the radar device 6 should be disposed in front of a swing actor such as the golf player g. By disposing the radar device 6 in front of the swing actor, it is possible to prevent the metal member 14 from being hidden by the swing actor during a swing. A swing robot is taken as an example of the swing actor in addition to the golf player g.

Figure 4:
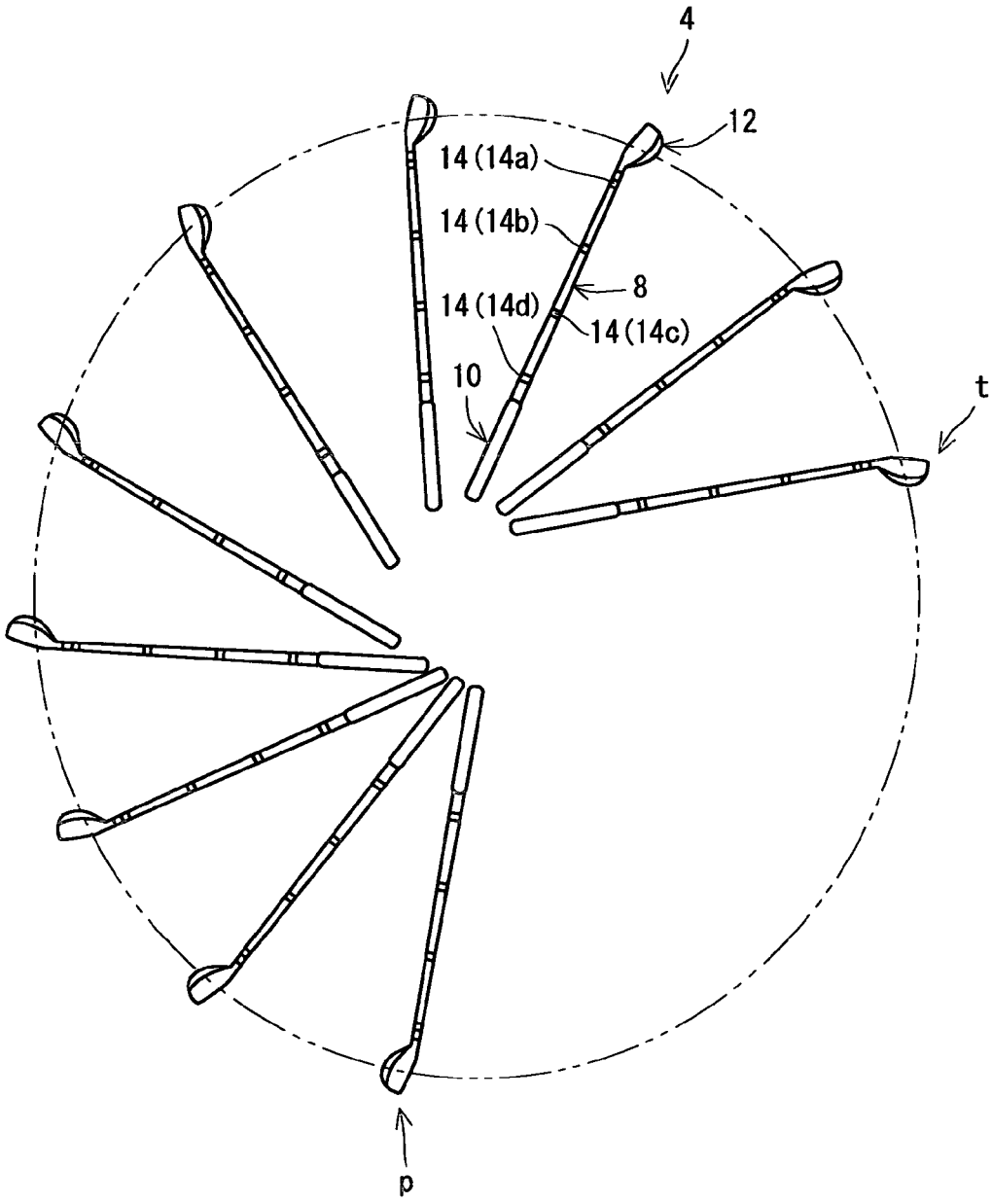
FIG. 4 is a view showing a part of a track of a golf club during a swing.

By the swing of the golf player g, the golf club 4 is moved. FIG. 4 is a view showing a track of the golf club 4 from a top-of-swing t to an impact p. The track shown in FIG. 4 is a part of the swing. The full range of the swing starts in an address state and reaches a finish via the top-of-swing t, the impact p and a follow-through. Within the full range of the swing, the respective metal members 14 are moved to take a shape of an almost circular arc. Within the full range of the swing, a range in which the metal member 14 can be moved includes an almost inside of a circle shown in a two-dotted chain line in FIGS. 1, 2 and 4. The circle (shown in the two-dotted chain line) includes a range in which a metal member 14*a* placed in the most distant position from the golf player g (the swing actor) can be moved.

The area of the measuring enable region of the radar device 6 depends on a beam width (which will also be referred to as a beam angle). A moving object within the beam width can be measured with high precision. The beam width is represented by a half value width of a power, for example. The half value width indicates an angular width set before a power transmitted from the transmitting portion is reduced to a half of the greatest value observed in front of the radar.

A radar wave is transmitted to take an almost conical shape from the transmitting portion of the radar device 6. The radar wave thus transmitted has a beam width $\theta$1 in a horizontal direction (see FIG. 2) and a beam width $\theta$2 in a vertical direction (see FIG. 1). In respect of a measurement of a shaft behavior within the full range of the swing, it is preferable that the radar device 6 should be provided in such a manner that all of the metal members 14 are positioned within the range of the beam width of the radar device 6 in the full range of the swing.

During the swing, a distance between each metal member 14 and the radar device 6 is changed with a time. In order to prevent an interference of the radar device 6 with the golf club 4 and to suppress a movement of the metal member 14 toward an outside of the measuring enable range of the radar device 6, a distance between the transmitting portion and the receiving portion 16 and the metal member 14 is preferably set to be equal to or greater than 0.5 m, is more preferably set to be equal to or greater than 0.7 m and is particularly preferably set to be equal to or greater than 1 m within the full range of the swing. In order to suppress a reduction in a strength of a received wave, the distance between the transmitting portion and the receiving portion 16 and the metal member 14 is preferably set to be equal to or smaller than 8 m, is more preferably set to be equal to or smaller than 6 m and is particularly preferably set to be equal to or smaller than 5 m within the full range of the swing.

The radar device 6 will be described below in detail.

Figure 5:
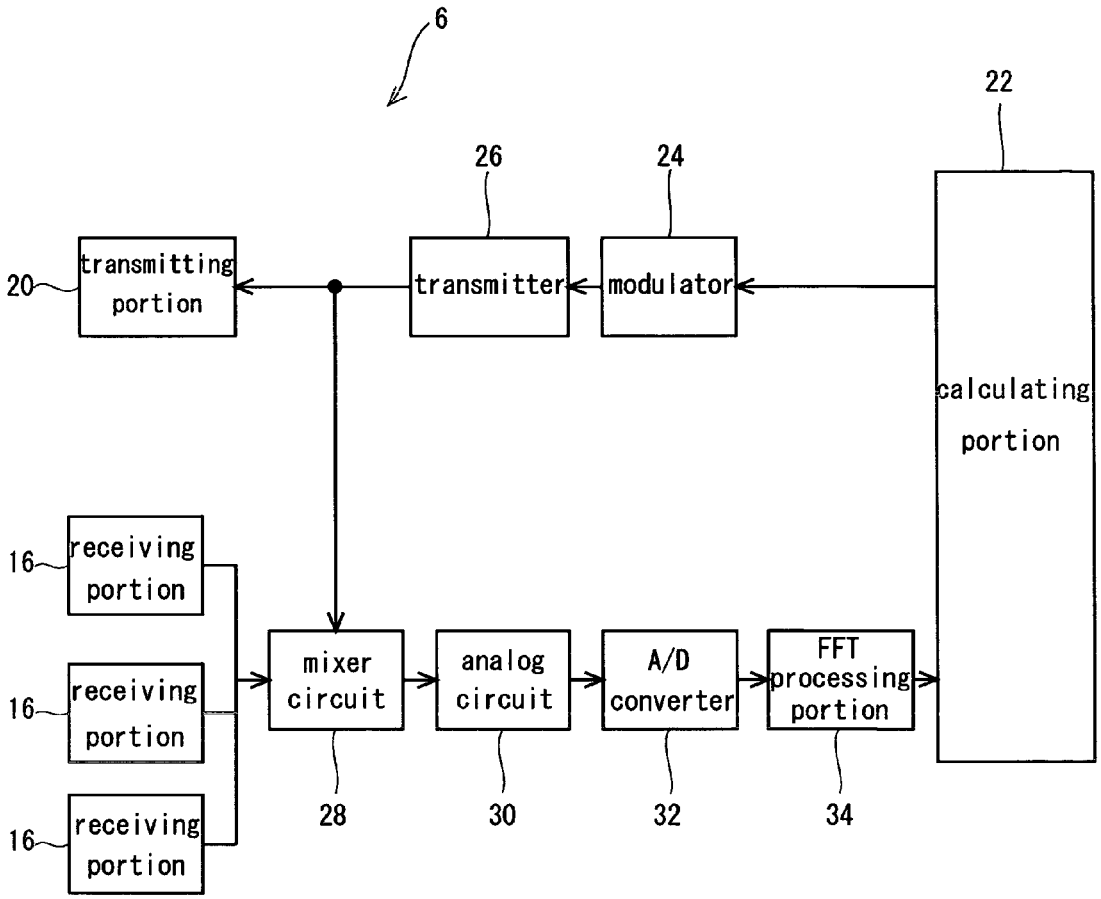
FIG. 5 is a diagram showing a schematic structure of the radar device.

FIG. 5 shows an example of a structure of the radar device 6. As described above, the radar device 6 has a transmitting portion 20 and the receiving portion 16. An electric wave (a radar wave) transmitted from the transmitting portion 20 hits on the metal member 14, and the electric wave (the radar wave) reflected from the metal member 14 is received by the receiving portion 16. Based on a signal (an electric wave) received by the receiving portion 16, the three-dimensional coordinates of the metal member 14 are calculated.

The three-dimensional coordinates of the metal member 14 are calculated based on three-dimensional information, for example, a three-dimensional azimuth, a three-dimensional velocity of the metal member 14 and the like. The three-dimensional coordinates of the metal member 14 are calculated by a calculating portion 22. The calculating portion 22 is provided in the computer portion or the radar device 6. The calculating portion 22 includes predetermined software, and a CPU and a memory in the computer portion for operating the software, for example.

The calculating portion 22 calculates three-dimensional coordinates at each time of the metal member 14 based on information obtained by the wave reflected from the metal member 14. The three-dimensional coordinates of each metal member 14 obtained based on the three-dimensional coordinates at each time may be displayed on a display portion of a computer (which is not shown). A typical example of the display portion is a monitor. The three-dimensional coordinates of the metal member 14 at each time may be displayed on the same screen. Based on the three-dimensional coordinates of the metal member 14 at each time, a virtual shape of the shaft 8 at each time may be displayed on the same screen (as shown in FIG. 4, for example).

In order to obtain the three-dimensional information (a three-dimensional azimuth, a three-dimensional velocity and the like) of the metal member 14, at least three receiving portions (receivers) are required. For this reason, the radar device 6 comprises at least three receiving portions. The three-dimensional information about the metal member 14 are obtained based on a difference in a received electric wave (a receiving signal) among the at least three receiving portions.

Examples of a method for obtaining the three-dimensional coordinates of the metal member 14 from the three-dimensional information of the metal member 14 include the following first and second methods. In the present invention, both of the first and second methods can be employed. The three-dimensional coordinates of the metal member 14 may be obtained by other methods.

The first method serves to obtain the three-dimensional azimuth of the metal member 14 as the three-dimensional information of the metal member 14, and furthermore, to obtain a distance between the metal member 14 and the radar device 6, thereby acquiring the three-dimensional coordinates of the metal member 14 from the three-dimensional azimuth and the distance which are thus obtained.

The second method serves to obtain the three-dimensional velocity of the metal member 14 as the three-dimensional information of the metal member 14 and to successively integrate the three-dimensional velocity thus obtained, thereby acquiring the three-dimensional coordinates of the metal member 14.

From the velocity of the metal member 14 and the three-dimensional azimuth of the metal member 14, the three-dimensional coordinates of the metal member 14 may be obtained.

In order to obtain the three-dimensional coordinates of the metal member 14, it is possible to propose the use of a plurality of radar devices. By only one radar device 6, the three-dimensional coordinates of the metal member 14 are obtained. A plurality of (three) receiving portions provided in the radar device 6 can acquire the three-dimensional coordinates by means of one radar device.

In order to obtain the azimuth of the metal member 14, it is possible to employ a well-known monopulse method, for example. The monopulse method can be applied to a radar having one transmitting portion and two receiving portions (a first receiving portion and a second receiving portion), for example. The positions of the first receiving portion and the second receiving portion are different from each other. Therefore, a phase difference θs is made between a wave reflected from a target received by the first receiving portion and a wave reflected from a target received by the second receiving portion. The following equation (A) is established, wherein a frequency of a radar wave transmitted from the transmitting portion is represented as fs, an azimuth angle of the target (in which a front is set to be 0 degree) is represented as β, a distance between the first receiving portion and the second receiving portion is represented as d, and a velocity of light is represented as c.

$$\theta s = 2\pi \cdot \sin \beta \cdot d \cdot fs / c \quad \text{(A)}$$

By the equation (A), it is understood that a two-dimensional azimuth angle can be measured. By providing three receiving portions having different positions from each other, it is possible to measure a three-dimensional azimuth angle (a three-dimensional azimuth).

By employing the monopulse method, it is possible to detect a target (that is, the metal member 14) within a wide range by one transmitting portion. More specifically, the beam width (which will also be referred to as the beam angle) can be increased to be approximately 100 degrees.

Figure 6:
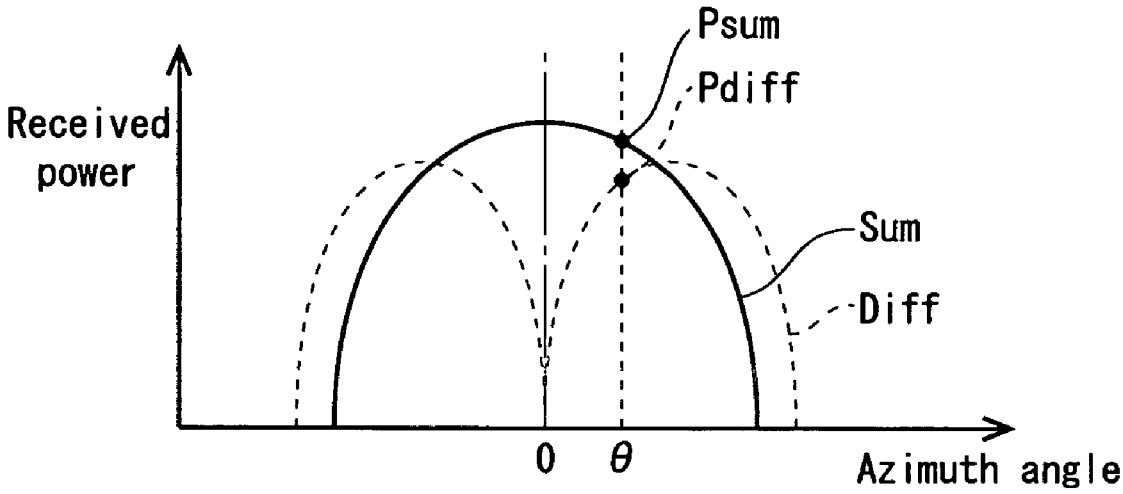
FIG. 6 is a graph showing a received power pattern for an azimuth angle θ of a metal member in the case in which two receiving portions are provided.

It is possible to calculate the azimuth of the target (the metal member 14) through the receiving portions disposed in different positions. FIG. 6 shows a received power pattern for an azimuth angle θ of the metal member 14 in the case in which two receiving portions are provided. In FIG. 6, "Sum" represents a pattern of a sum signal obtained by signals input to the first and second receiving portions and "Diff" represents a pattern of a difference signal obtained by the signals input to the first and second receiving portions. The azimuth angle θ is specified by a sum signal Psum and a difference signal Pdiff of received waves obtained at specific times.

In order to obtain the three-dimensional azimuth of the metal member 14, azimuths angles θ in two different directions are required. As a radar device for obtaining the azimuth angles θ in the two different directions, it is possible to propose radar devices having receiving portions disposed in different positions in a first direction (for example, a vertical direction) and receiving portions disposed in different positions in a second direction (for example, a transverse direction). In this case, at least three receiving portions are required. One transmitting portion is enough. Description will be given to the case in which the first direction is set to be the vertical direction and the second direction is set to be the transverse direction. An azimuth angle (that is, an angle of elevation) in the vertical direction (a perpendicular direction) is obtained based on signals received by the receiving portions disposed in the different positions in the vertical direction. An azimuth angle in the transverse direction (a horizontal direction) is obtained based on signals received by the receiving portions disposed in different positions in the transverse direction. A three-dimensional azimuth is obtained from the azimuth angle in the vertical direction and the azimuth angle in the transverse direction. Four receiving portions may be provided. For the four receiving portions, each of two receiving portion is provided in each position in the vertical direction and each of other two receiving portion is provided in each position in the transverse direction separately therefrom, for example. Five receiving portions or more may be provided.

The distance between the radar device 6 and the metal member 14 can be calculated based on a time required from a transmission to a receipt. Moreover, the distance between the radar device 6 and the metal member 14 can be obtained by receiving an electric wave having two types of frequencies transmitted from the same transmitting portion through the receiving portions. The velocity of the metal member 14 can be calculated based on a Doppler shift. The radar device 6 is a Doppler radar. The radar device 6 can calculate a velocity of the metal member 14 based on the Doppler shift.

The radar device 6 can calculate the velocity of the metal member 14 and the distance to the metal member 14. As shown in FIG. 5, the radar device 6 has a modulator 24 and a transmitter 26 in addition to the transmitting portion 20, the receiving portion 16 and the calculating portion 22. A signal in a millimeter wave band transmitted from the transmitter 26 at a transmitting frequency based on a modulation signal sent from the modulator 24 is transmitted from the transmitting portion 20. A radio signal reflected from the metal member 14 is received by the receiving portion 16.

The radar device 6 has a mixer circuit 28, an analog circuit 30, an A/D converter 32 and an FFT processing portion 34. The radio signal received by the receiving portion 16 is frequency converted by the mixer circuit 28. A signal sent from the transmitter 26 is supplied to the mixer circuit 28 in addition to the radio signal received by the receiving portion 16. The mixer circuit 28 mixes the signal sent from the receiving portion 16 and the signal sent from the transmitter 26. A signal generated by the mixing operation is output to the analog circuit 30. A signal amplified by the analog circuit 30 is output to the A/D converter 32. A signal converted into a digital signal through the A/D converter 32 is supplied to the FFT processing portion 34. The FFT processing portion 34 carries out Fast Fourier Transform (FFT). By the Fast Fourier Transform, information about an amplitude and a phase are obtained from a frequency spectrum of the signal and are supplied to the calculating portion 22. The calculating portion 22 calculates the distance to the metal member 14 and the velocity of the metal member 14 from the information supplied from the FFT processing portion 34.

By utilizing the Doppler shift, it is possible to calculate the velocity of the metal member 14 (a relative velocity of the radar device 6 and the metal member 14). By utilizing a 2-frequency CW (Continuous Wave) method, for example, it is possible to calculate the distance to the metal member 14 (the distance from the radar device 6 to the metal member 14).

Figure 7:
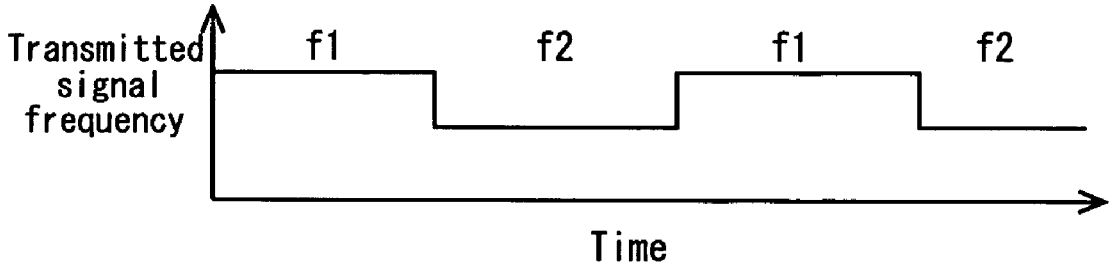
FIG. 7 is a graph showing a relationship between a frequency transmitted from a transmitting portion and a time in case of a 2-frequency CW method.

In case of the 2-frequency CW method, a modulation signal is input to the transmitter 26 and the transmitter 26 supplies two frequencies f1 and f2 to the transmitting portion 20 while switching them on a time basis. As shown in FIG. 7, the transmitting portion 20 transmits the two frequencies f1 and f2 with a switch on a time basis. The electric wave transmitted from the transmitting portion 20 is reflected by the metal member 14. A reflection signal is received by the three receiving portions 16. The receiving signal and the signal of the transmitter 26 are mixed by the mixer circuit 28 so that a beat signal is obtained. In case of a homodyne method for carrying out a direct conversion to a baseband, the beat signal output from the mixer circuit 28 has a Doppler frequency. A Doppler frequency fd is obtained by the following equation (1).

$$fd=(2f_c/c)v \quad (1)$$

In the equation (1), $f_c$ represents a carrier frequency, v represents a relative velocity (that is, a velocity of the metal member 14), and c represents a velocity of light. Received signals at respective transmission frequencies are separated and demodulated by the analog circuit 30 and are A/D converted through the A/D converter 32. Digital sample data obtained by the A/D conversion are subjected to the Fast Fourier Transform processing by the FFT processing portion 34. A frequency spectrum in a full frequency band of the received beat signal is obtained by the Fast Fourier Transform processing. Based on the principle of the 2-frequency CW method, a power spectrum of a peak signal having the transmission frequency f1 and a power spectrum of a peak signal having the transmission frequency f2 are obtained for the peak signals acquired as a result of the Fast Fourier Transform processing. Based on a phase difference ϕ between the two power spectra, a distance R to the metal member 14 is calculated by the following equation (2).

$$R=(c\cdot\phi)/(4\pi\cdot\Delta f) \quad (2)$$

In the equation (2), c represents a velocity of light and Δf represents (f2−f1).

In the way described above, the distance to the metal member 14 and the three-dimensional azimuth of the metal member 14 are grasped so that the three-dimensional coordinates of the metal member 14 are defined univocally.

It is also possible to calculate the three-dimensional coordinates of the metal member 14 by successively integrating the three-dimensional velocity of the metal member 14. In order to obtain the three-dimensional velocity of the metal member 14, the principle of the Doppler shift is utilized. In order to obtain the three-dimensional velocity, at three receiving portions 16 are provided. It is preferable that all of the receiving portions 16 should be provided in the radar device 6. Three receiving portions or more are disposed in different positions from each other. Since the receiving portions 16 are disposed in the different positions, the relative velocities of the receiving portions 16 and the metal member 14 are different from each other. Based on the relative velocity of each of the receiving portions 16 and the metal member 14, the three-dimensional velocity of the metal member 14 is calculated. The three-dimensional velocity is integrated by the calculating portion 22.

It is also possible to calculate one-dimensional coordinates of the metal member 14 by successively integrating a one-dimensional velocity of the metal member 14. It is also possible to calculate two-dimensional coordinates of the metal member 14 by successively integrating a two-dimensional velocity of the metal member 14. In this case, it is possible to obtain the three-dimensional coordinates of the metal member 14 by combining the one-dimensional coordinates or two-dimensional coordinates thus obtained and other data (the azimuth of the metal member 14 and the like).

The three-dimensional coordinates of the metal member 14 may be obtained from the velocity of the metal member 14 acquired from the Doppler shift and the azimuth of the metal member 14 acquired by the monopulse method. The radar device 6 has the receiving portion 16*a*, the receiving portion 16*b* and the receiving portion 16*c* which are provided in different positions from each other. Therefore, it is possible to measure the three-dimensional azimuth of the target (the metal member 14) by the monopulse method.

It is preferable that the shaft behavior automatic measuring system 2 should have a trigger device. The trigger device generates a trigger signal for controlling a timing for fetching data. The trigger device may be provided in the radar device 6 and may be provided separately from the radar device 6. The trigger device gives the trigger signal to the radar device 6. The trigger device may have a laser sensor, for example, and may generate the trigger signal when a laser of a laser sensor is intercepted. The laser of the laser sensor is oriented in an almost vertical direction, for example. A position in which the laser of the laser sensor is to be disposed can be selected properly according to the purpose for a measurement. The laser of the laser sensor may be disposed ahead of a position of a ball before hitting (for example, ahead of the position of the ball before the hitting by approximately 1 to 10 cm). In this case, when the hit ball intercepts the laser, the trigger signal can be generated. The laser of the laser sensor may be disposed behind the position of the ball before the hitting (for example, behind the position of the ball before the hitting by approximately 1 to 10 cm). In this case, when the head 12 in an initial stage of a backswing intercepts the laser, the trigger signal can be generated.

The trigger device may generate the trigger signal in a moment of an impact. For example, the trigger device may have an acceleration sensor attached to the head 12 and the acceleration sensor may generate the trigger signal when detecting an impulsive force in the impact. Usually, a time required for a swing is approximately three seconds and a time required from the impact to a finish is approximately two seconds. By generating the trigger signal in the moment of the impact and setting predetermined times before and after the impact (for example, one second before the impact and two seconds after the impact) as a data fetch time, therefore, it is possible to carry out the measurement within a full range of the swing. It is also possible to use a trigger device for manually generating the trigger signal. For example, it is also possible to use a trigger device for generating the trigger signal by pushing a push button.

The calculating portion 22 can distinguish the metal members 14 disposed in the different positions in the longitudinal direction of the shaft. The calculating portion 22 can distinguish the metal members 14 disposed in the different positions in the longitudinal direction of the shaft by comparing a magnitude of the velocities (three-dimensional velocities) of the metal members 14, for example. At each time during a swing, the metal member 14*a* positioned in the closest position to the head 12 has a higher magnitude of the velocity (three-dimensional velocity) than the other metal members (metal members 14*b*, 14*c* and 14*d*). At each time during the swing, the metal member 14*d* positioned in the closest position to the grip 10 has a lower velocity (three-dimensional velocity) than the other metal members (the metal members 14*a*, 14*b* and 14*c*). At each time during the swing, the metal member 14 positioned closer to the head 12 has a higher magnitude of the velocity. In other words, at each time during the swing, the metal member 14 positioned closer to the grip 10 has a lower magnitude of the velocity. The calculating portion 22 can measure the velocity of each of the metal members 14 disposed in the different positions in the longitudinal direction of the shaft. At each time during the swing, the calculating portion 22 arranges the velocity of each of the metal members 14 in order. Based on the ordering, the metal members 14 placed in the different positions in the longitudinal direction of the shaft are distinguished from each other. From the three-dimensional positions of the metal members 14*a*, 14*b*, 14*c* and 14*d* at each time, the three-dimensional shape of the shaft 8 at each time can be calculated.

In order to easily measure the metal member 14 within the full range of the swing, the beam width θ1 (see FIG. 2) in the horizontal direction of the radar device 6 is preferably equal to or greater than 10 degrees and is more preferably equal to or greater than 20 degrees. In order to prevent an excessive diffusion of the transmitted electric wave to enhance the precision in the measurement, the beam width θ1 in the horizontal direction is preferably equal to or smaller than 90 degrees and is more preferably equal to or smaller than 80 degrees.

In order to easily measure the metal member 14 within the full range of the swing, the beam width θ2 (see FIG. 1) in the vertical direction of the radar device 6 is preferably equal to or greater than 10 degrees and is more preferably equal to or greater than 20 degrees. In order to prevent the excessive diffusion of the transmitted electric wave to enhance the precision in the measurement, the beam width θ2 in the vertical direction is preferably equal to or smaller than 90 degrees and is more preferably equal to or smaller than 80 degrees.

In order to enhance the precision in the measurement, it is preferable that the distance d between the receiving portions 16 should be equal to or greater than 20 cm (see FIG. 3). In order to enhance the precision in the measurement, it is preferable that a distance d1 on the receiving portion installation surface 17 between the receiving portions 16*a* and 16*b* should be set to be equal to or greater than 20 cm. In order to enhance the precision in the measurement, it is preferable that a distance d2 between the receiving portion 16*a* or 16*b* and the receiving portion 16*c* in the direction of the perpendicular bisector L2 should be set to be equal to or greater than 20 cm. In order to accommodate a plurality of receiving portions 16 in one radar device 6, and at the same time, to reduce the size of the radar device 6, it is preferable that the distanced should be set to be equal to or smaller than 40 cm. In order to accommodate a plurality of receiving portions 16 in one radar device 6, and at the same time, to reduce the size of the radar device 6, it is preferable that the distance d1 should be set to be equal to or smaller than 40 cm. In order to accommodate the receiving portions 16 in one radar device 6 and to reduce the size of the radar device 6 at the same time, it is preferable that the distance d2 should be set to be equal to or smaller than 40 cm. The distances d, d1 and d2 can be measured based on a position in which an electric wave is actually received, that is, a position of a receiving antenna.

In order to eliminate a noise to enhance the precision in the measurement, it is preferable that electromagnetic waves other than the radar wave of the radar device 6 should not be generated in the vicinity of a place for the measurement. For example, it is preferable that a fluorescent lamp should not be turned on in the place for the measurement. In order to eliminate the noise to enhance the precision in the measurement, it is preferable that the place for the measurement should be set to be outdoor.

As described above, a subject containing metal powder such as the coating material containing metal powder or the resin sheet containing metal powder is taken as an example of the metal member. A weight of the metal powder which is contained is represented as M1 and a total weight of the metal member containing the metal powder is represented as M2. In order to increase a reflectance of a radar wave, a weight ratio (M1/M2) is preferably set to be equal to or higher than 0.2, is more preferably set to be equal to or higher than 0.25 and is particularly preferably set to be equal to or higher than 0.3. In order to enhance a flexibility of the metal member to improve an adhesion of the metal member to the surface of the shaft, the weight ratio (M1/M2) is preferably set to be equal to or lower than 0.9, is more preferably set to be equal to or lower than 0.87 and is particularly preferably set to be equal to or lower than 0.85.

The automatic measuring system according to the present invention can measure the behaviors of the head and the ball in addition to the behavior of the shaft. The head and the ball which contain metal atoms can be measured with high precision by the radar device. Referring to the head, for example, it is possible to measure a head speed, a loft angle, a face angle, a head posture and the like at each time during a swing. Referring to the ball, for example, it is possible to measure an initial speed, a three-dimensional azimuth in a launch, an spin rate in the launch and the like. In order to carry out the measurement, the metal member may be provided in necessary portions on the surfaces of the head and the ball.

In the case in which a strain gauge is stuck to carry out the measurement as in the conventional art, there is a problem in that a wiring to be connected to the strain gauge is an obstacle and the golf player g cannot perform a normal swing. Moreover, weights of the strain gauge, the wiring and the like are great. With an increase in weights of the shaft and the club, therefore, there is a problem in that the golf player g cannot perform the normal swing. Also in the case in which the swing actor is a swing robot, it is necessary to carry out a complicated work for devising the wiring to be connected to the strain gauge in such a manner that the same wiring is not disconnected during the swing. Moreover, there is a problem in that the specifications of the golf club and the club shaft to be measuring targets are changed greatly with an increase in the weights of the shaft and the club. According to the present embodiment, it is possible to carry out the measurement by simply providing the metal member on the shaft of the golf club to be the measuring target. Therefore, the increase in the weight is small. Moreover, the wiring is not necessary. Consequently, the swing is not disturbed by the wiring. During the measurement, the golf player g can carry out the normal swing.

In the case in which the strain gauge is stuck to carry out the measurement, it is necessary to deform the strain gauge integrally with the surface of the shaft in order to enhance the precision in the measurement. In order to integrate the strain gauge with the surface of the shaft, it is necessary to shave off the coating material coated over the surface of the shaft, thereby exposing a material of the shaft to cause the strain gauge to adhere to the exposed surface. In order to integrate the strain gauge with the surface of the shaft, moreover, it is necessary to bond the surface of the shaft to the strain gauge with a high-strength adhesive. On the other hand, when an adhesive layer is excessively thickened, the strain gauge and the material of the shaft are not deformed integrally. For this reason, it is necessary to thin the adhesive layer. It is hard to manage a thickness of the adhesive layer. Therefore, the thickness of the adhesive layer is hard to be constant. Due to a variation in the adhesive layer, the precision in the measurement is deteriorated in some cases. In the present invention, the metal member can easily be disposed. For example, it is possible to dispose the metal member by simple sticking, winding or coating.

The above description is only illustrative and various changes can be made without departing from the scope of the present invention.

What is claimed is:

1. A shaft behavior automatic measuring system for measuring the behavior of a shaft in a golf club as the golf club undergoes a swinging movement imparted by a swing actor, the system comprising:

a metal member provided on a surface of the shaft in the golf club and a Doppler radar;

the Doppler radar including at least one transmitting portion for emitting a radar wave to the metal member in the golf club during the swinging movement and at least three receiving portions for receiving the radar wave reflected from the metal member; wherein a distance between the Doppler radar and the metal member throughout the swinging movement is at least 0.5 m and no more than 8 m; and wherein the wave emitted by the Doppler radar has (1) a beam width in a horizontal direction that includes the horizontal range of the movement of the metal member and (2) a beam width in a vertical direction that includes the vertical range of movement of the metal member; and a calculating portion for calculating three-dimensional coordinates of the metal member based on a signal received by the at least three receiving portions.

2. The shaft behavior automatic measuring system according to claim 1, wherein the metal member is set to be a coating material containing metal powder, a resin sheet containing metal powder, a metallic foil or a metallic thin film, and a total weight of the metal member is equal to or smaller than 3% of a total weight of the club.

3. The shaft behavior automatic measuring system according to claim 1, wherein the metal member is provided in a plurality of portions in the longitudinal direction of the shaft.

4. The shaft behavior automatic measuring system according to claim 1, wherein the position of the metal member in the longitudinal direction of the shaft is placed in 3 portions or more and 20 portions or less.

5. The shaft behavior automatic measuring system according to claim 1, wherein the length of the metal member in the longitudinal direction of the shaft is set to be 1 mm or greater and 40 mm or less.

6. The shaft behavior automatic measuring system according to claim 1, wherein the distance in the longitudinal direction of the shaft between the metal member which is placed in the closest position to the head and an end face of a neck of the head is set to be 200 mm or less, and a distance in the longitudinal direction of the shaft between the metal member which is placed in the closest position to the grip and an edge on the head side of the grip is set to be 200 mm or less.

7. The shaft behavior automatic measuring system according to claim 1, wherein the radar device is a millimeter wave radar.

8. The shaft behavior automatic measuring system according to claim 1, wherein the radar wave reflected from the exposed surface of the metal member is distinguished from the radar wave reflected from the non-metal member by providing a predetermined threshold on a strength of the received wave.

* * * * *